US005802886A

United States Patent [19]

Kim

[11] Patent Number: 5,802,886

[45] Date of Patent: Sep. 8, 1998

[54] SPIN BASKET FOR A WASHING MACHINE

[75] Inventor: Jae-Sin Kim, Suwon, Rep. of Korea

[73] Assignee: Samsung Electronics Co., Ltd., Suwon, Rep. of Korea

[21] Appl. No.: 854,817

[22] Filed: May 12, 1997

[30] Foreign Application Priority Data

May 30, 1996 [KR] Rep. of Korea ..... 1996-13836
May 30, 1996 [KR] Rep. of Korea ..... 1996-13837

[51] Int. Cl.[6] ..... D06F 37/06

[52] U.S. Cl. ..... 68/142; 34/602

[58] Field of Search ..... 68/24, 142, 143, 68/144, 145, 146; 34/596, 599, 602; 366/228; 210/380.2, 380.3; 451/328

[56] References Cited

U.S. PATENT DOCUMENTS 351,062 10/1886 Mathews ..... 68/142
2,855,698 10/1958 Hutt ..... 34/602 X

FOREIGN PATENT DOCUMENTS 586299 12/1958 Italy ..... 68/142
32700 2/1991 Japan ..... 34/602

*Primary Examiner*—Philip R. Coe
*Attorney, Agent, or Firm*—Burns, Doane, Swecker & Mathis, L.L.P.

[57] ABSTRACT

A spin basket for a clothes washing machine has a cylindrical side panel, formed by joining two ends of a rectangular sheet to each other by back-folding the ends around one another to form a joint. The cylindrical panel includes inwardly projecting lifters adapted to raise laundry as the panel rotates. The joint is formed in one of the lifters to strengthen the joint against centrifugal force occurring during rotation of the panel. The back-folded ends of the joint engage one another along an interface. The ends may include intermeshing bosses and grooves extending along the interface, to reinforce the joint.

4 Claims, 5 Drawing Sheets

FIG. 2
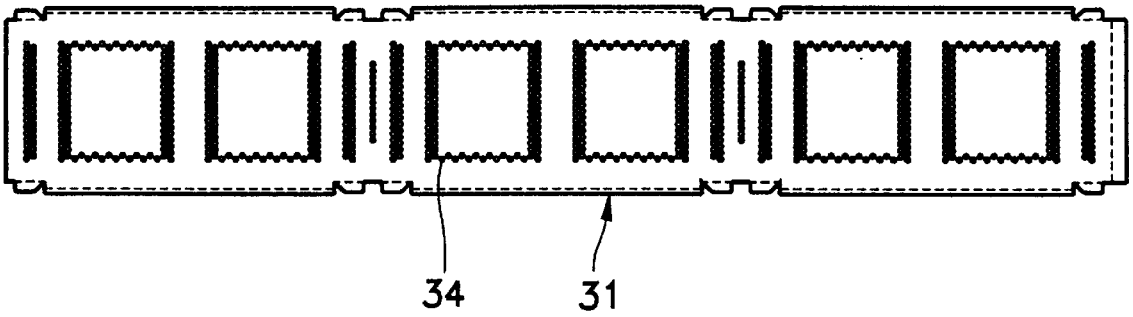
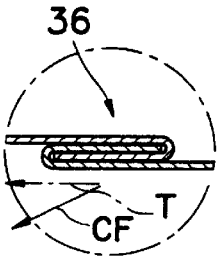
FIG. 3A
FIG. 3
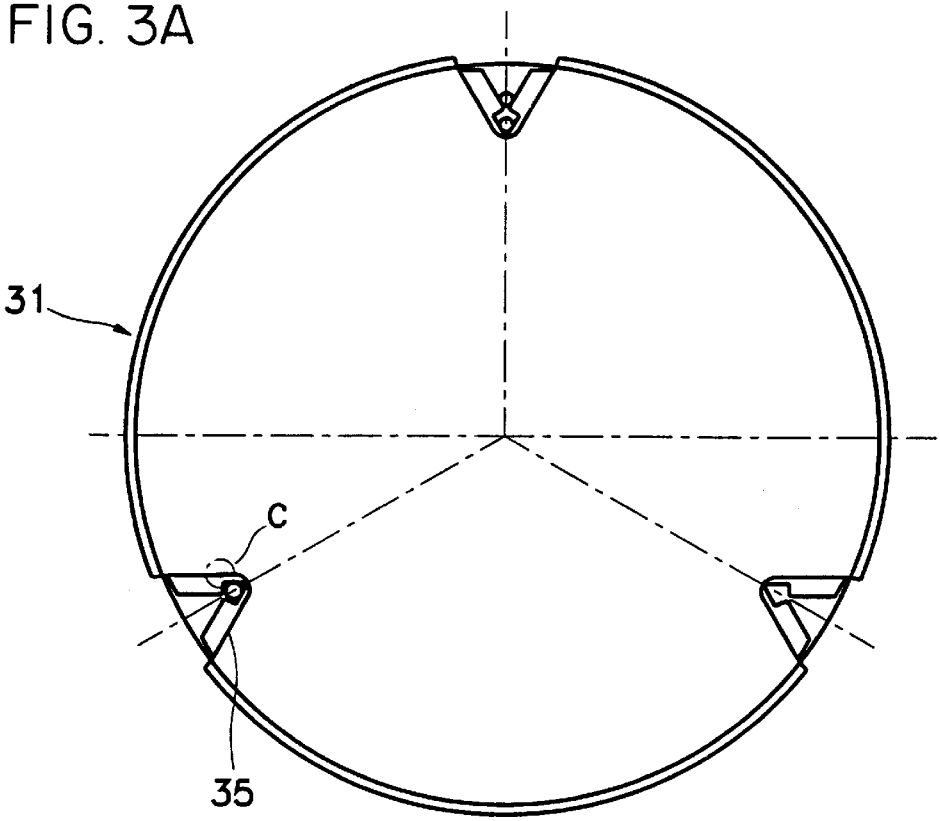

FIG. 4
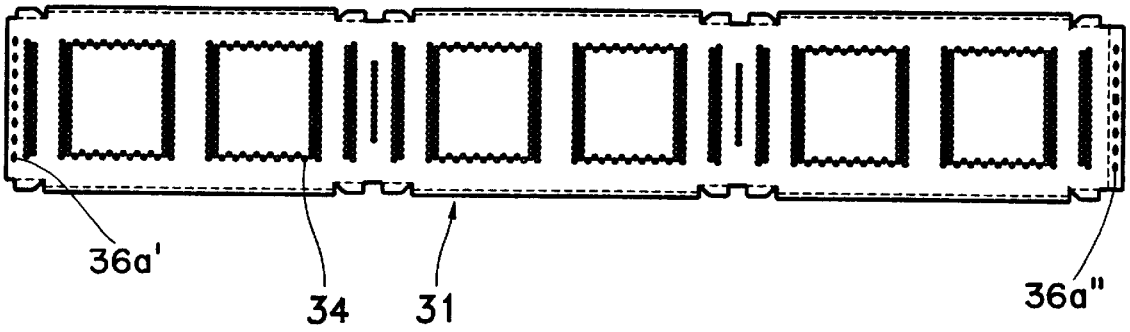
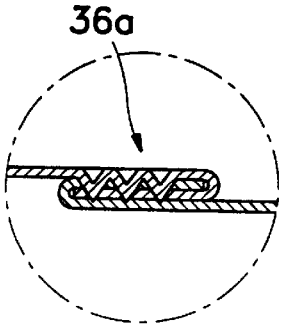
FIG. 5A
FIG. 5
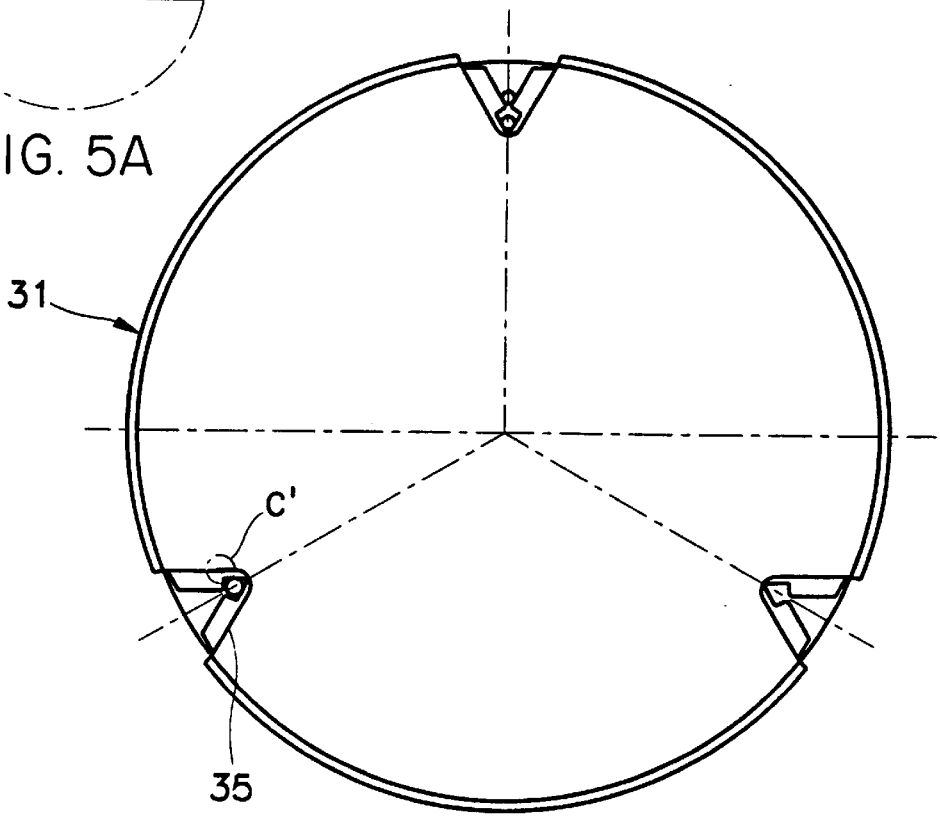

FIG. 7
(PRIOR ART)
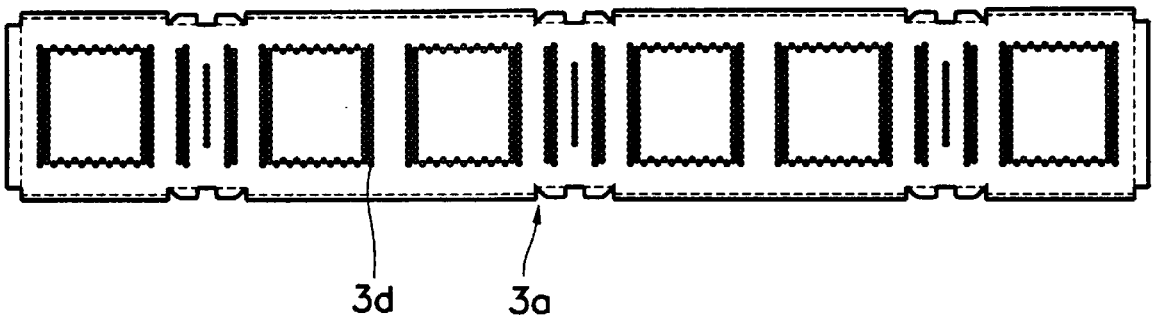
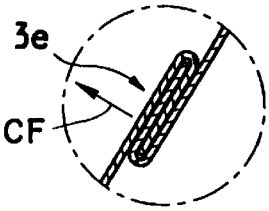
FIG. 8
(PRIOR ART)
FIG. 8A
(PRIOR ART)
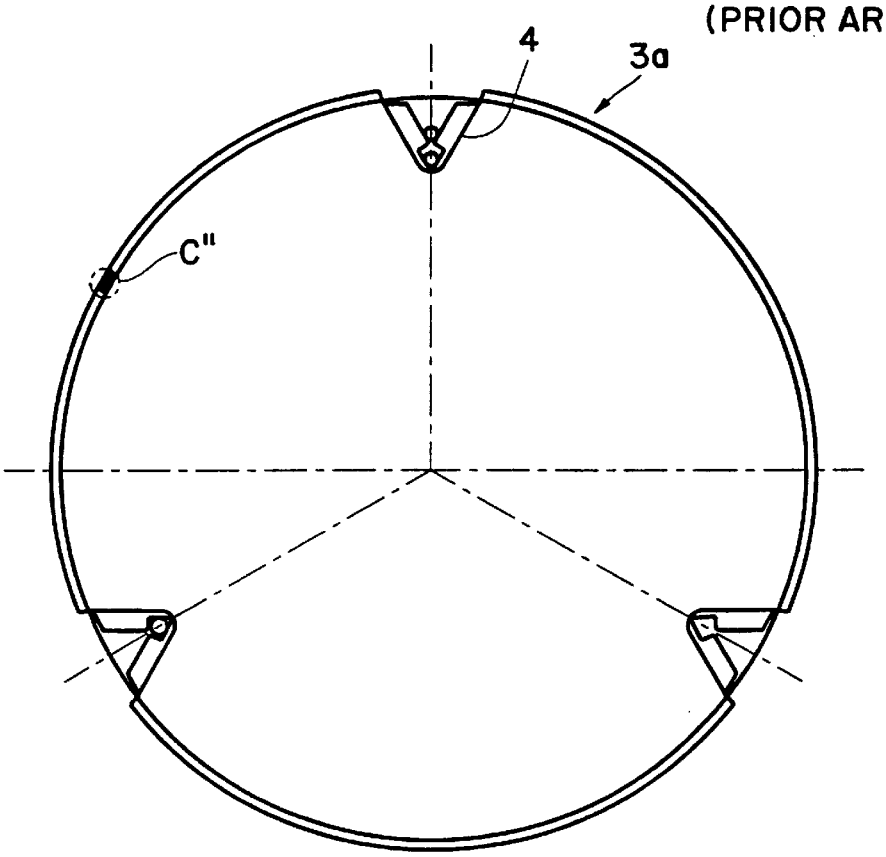

SPIN BASKET FOR A WASHING MACHINE

BACKGROUND OF THE INVENTION

1. Field of the Invention

The present invention generally relates to the construction of a spin basket for a washing machine.

2. Description of the Prior Art

A conventional drum washing machine is an electronic appliance in which clothes are washed by the suds generated by the rotation of its drum shaped spin basket. With the conventional drum washing machine, washing, rinsing and hydro-extracting tasks are automatically carried out according to a specific program.

FIG. 6 is a sectional view of the overall construction of a conventional drum washing machine.

Referring to FIG. 6, the drum washing machine includes a housing 1, a tub 2 suspended by suspension springs 5, and a spin basket 3 rotatably installed in the tub 2. The spin basket 3 is comprised of a cylindrically shaped side panel 3*a*, and front and rear panels 3*b* and 3*c* respectively joined to the front and back of the side panel 3*a*. A plurality of small holes 3*d* are uniformly formed on the side panel, and a plurality of lifters 4 protrude inward therefrom. Water that is removed from clothes in the spin basket 3 by centrifugal force flows into the tub 2 through these small holes 3*d*, and the lifters 4 raise and drop the laundry during washing.

The side panel 3*a*, as shown in FIGS. 7, 8A, is formed by bending a rectangular panel into a cylinder and then joining both edges of the panel at a joint 3*e* formed by interlocking folds. In the spin basket of the conventional drum washing machine, the centrifugal force CR created by the rotation of the spin basket acts on the joint 3*e*, and the seaming may be released. That is, the centrifugal force created by the rotating laundry and water during the washing operation, and the centrifugal force generated by the high-speed rotation of the spin basket 3 during the hydro-extracting process, are directly transferred to the joint 3*e* so that the joint 3*e* may be released, thus requiring the replacement of the spin basket 3, or causing the breakage of the entire drum washing machine, depending on the circumstances.

SUMMARY OF THE INVENTION

It is the objective of the present invention to provide a spin basket for a drum washing machine, in which the joint between the cylindrical side panel's edges is positioned in one of the inward-protruding lifters, and a plurality of bosses and grooves are formed on the joint to reinforce it, so that the spin basket is more resistant to the centrifugal force applied to the joint, and disconnection of the joint is prevented.

In order to obtain the aforementioned objective, there is disclosed a spin basket for a washing machine having a cylindrical side panel formed by joining two edges of a rectangular sheet to each other to form a joint, and a plurality of inward-protruding lifters, wherein the joint is positioned in one of the lifters. Reinforcing members are formed on the joint to increase the joint's strength. The reinforcing members include bosses formed on one end of the side panel, and grooves formed on the other end of the side panel so that the bosses fit into the grooves.

BRIEF DESCRIPTION OF THE DRAWINGS

In the accompanying drawings:

FIG. 2 is a development view of a spin basket's side panel in accordance with a first preferred embodiment of the present invention;

FIG. 3 is a side view of a connecting structure of the spin basket's side panel in accordance with the present invention;

FIG. 3A is an enlargement of a portion of FIG. 3 indicated by a circle C;

FIG. 4 is a development view of a spin basket's side panel in accordance with a second preferred embodiment of the present invention;

FIG. 5 is a side view of a connecting structure of the spin basket's side panel shown in FIG. 4;

FIG. 5A is an enlargement of a portion of FIG. 5 indicated by a circle C;

FIG. 7 is a development view of the spin basket shown in FIG. 6;

FIG. 8 is a side view of a connecting structure of the spin basket's side panel in accordance with the conventional art and, FIG. 8A is an enlargement of a portion of FIG. 8 indicated by a circle C.

DETAILED DESCRIPTION OF THE PREFERRED EMBODIMENTS

The preferred embodiments of the present invention will now be described in detail with reference to the accompanying drawings.

Figure 1:
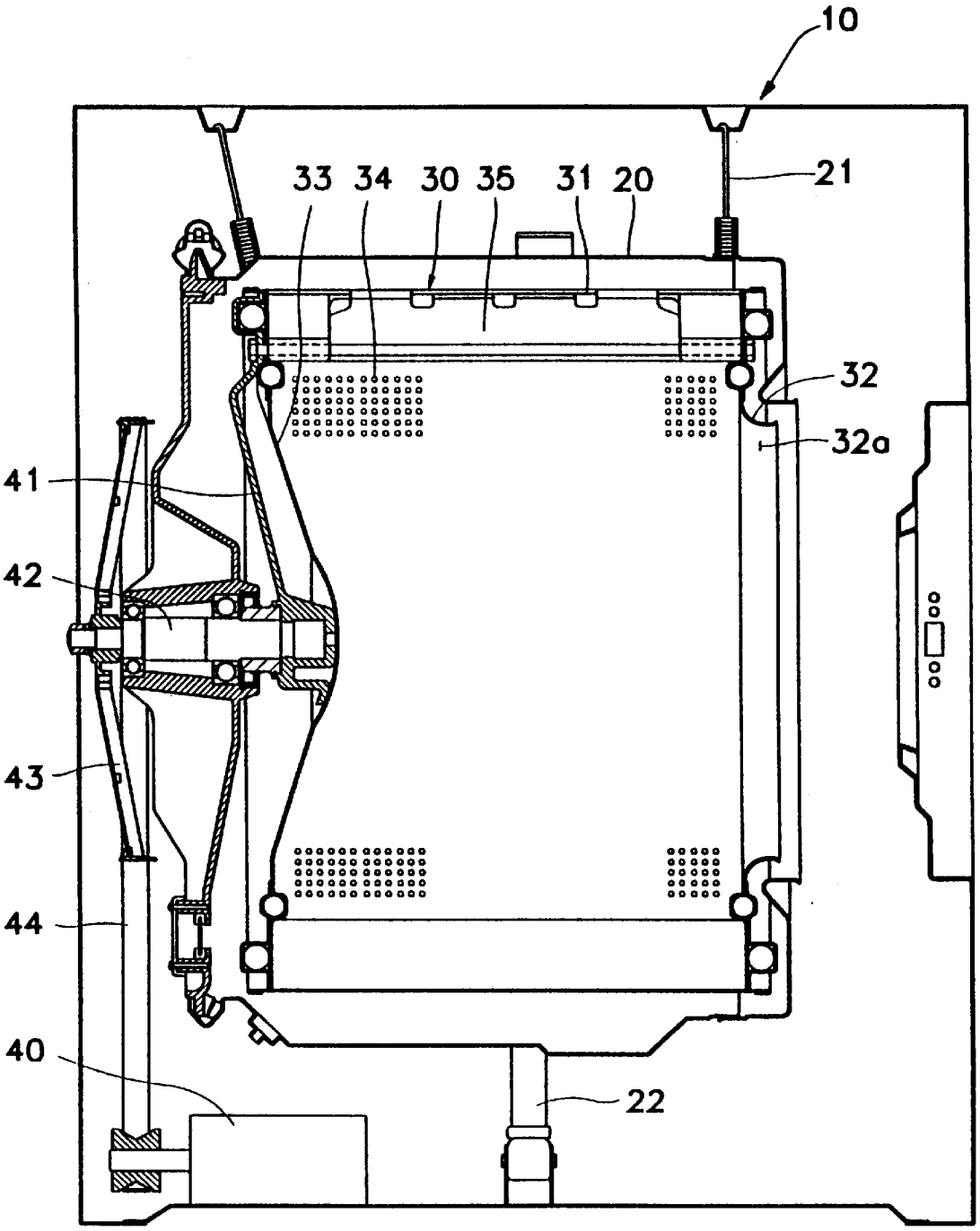
FIG. 1 is a sectional view showing the overall construction of a drum washing machine in accordance with the present invention.
Figure 6:
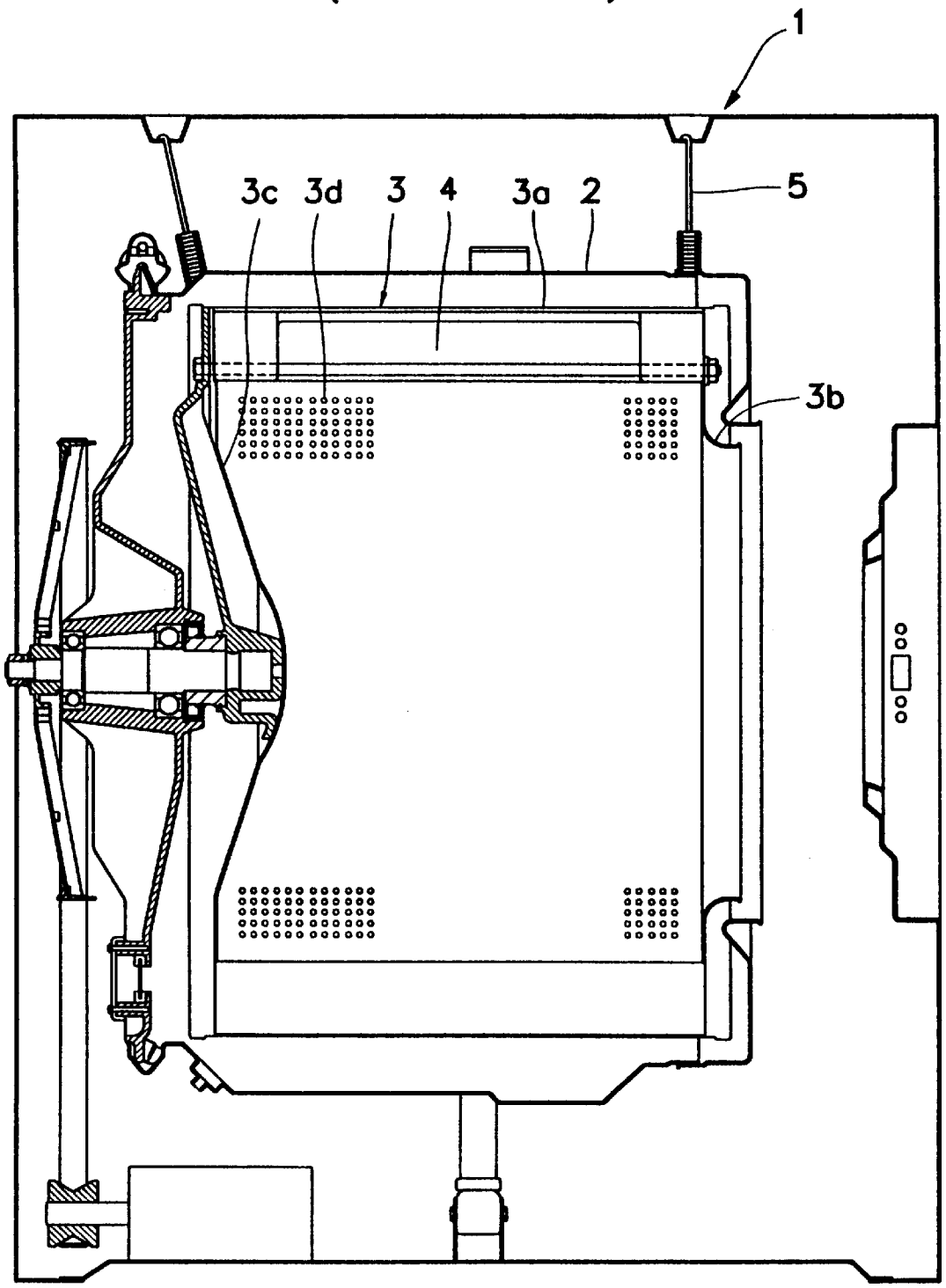
FIG. 6 (PRIOR ART)
FIG. 6 is a sectional view showing the overall construction of a conventional drum washing machine.

FIG. 1 is a sectional view showing the overall construction of a drum washing machine in accordance with the present invention.

As shown in FIG. 1, the drum washing machine includes a housing 10, a tub 20 suspended in the housing 10, and a spin basket 30 rotatably installed within the tub 20. The tub 20 is suspended by a plurality of suspension springs 21, that connect the tub outer surface with the housing ceiling. Additionally, a pair of shock absorbing members 22 are provided under the tub 20.

The spin basket 30 consists of a cylindrically-shaped side panel 31, and front and rear panels 32 and 33 respectively joined to the front and back of the side panel 31. A shaft 42 is connected to the rear panel 33, and extend rearwardly from the tub 20. A first pulley 42 is connected to an electric driving motor 40, and a second pulley 43 is connected to the end of the shaft 42. A flange 41 is provided to connect the rear panel 33 with the shaft 42. The shaft 42 turns by receiving rotating force from the driving motor 40 through a belt 44 and the pulley 43. The front panel 32 includes an opening 32a through which the laundry can be put into or taken out of the spin basket 30.

A plurality of holes 34 are uniformly formed in the side panel 31, which allow water to flow freely between the tub 20 and the spin basket 30, and provide a path through which water removed from the laundry during the hydro-extracting process can drain into the tub 20. Three V-Shaped lifters, spaced 120° from each other, are formed protruding inward from the side panel 31, for the purpose of rasing and dropping the laundry during washing.

The formation-of the side panel 31 by bending a rectangular metal sheet into a cylindrical panel, is more fully described referring to FIGS. 2 and 3.

The side panel 31 is formed by bending a rectangular metal sheet into a cylindrical panel, and then forming a joint 36 between both edges. The joint 36, a feature of the present invention, is formed in one of the lifters 35 so that the direction of the centrifugal force CF with respect to the joint is different as compared to FIG. 8A. The type of joint used in this invention is most resistant to tensile force. Positioning the joint 36 on one lifter 35 causes a large portion of the aforementioned centrifugal force to be applied as a tensile force T thus maximizing the utilization of the joint's strength. The joint 36 is formed as interlocking folds (seaming). That is, the two edges of the side panel 31 are each folded back 180°, and then compressed from both sides to interlock the folds.

The following description relates to the operation and advantage of the inventive drum washing machine.

When the washing machine starts to operate in the state that water and laundry are contained in the tub 20 and the spin basket 30, the spin basket 30 rotates forward and reverse by receiving the rotating force of the driving motor 40 through the belt 44. As the spin basket 30 turns, the laundry is tumbled through the water, and is raised and dropped by the lifters 35. After washing, the high speed rotation of the spin basket 30 throws off excess water from the laundry during the hydro-extracting process. The water drains into the tub 20 through the small holes 34, and is discharged to outside by a draining device (not illustrated).

The joint 36 positioned in one of the inward-protruding lifters 35 is able to more efficiently resist the centrifugal force created by the water and laundry, which prevents the joint 36 from being disjoined, thereby enhancing the reliability of the drum washing machine.

The technical concept of the present invention is not limited to this embodiment, and, as shown in FIGS. 4 and 5A, reinforcing members 36*a*' and 36*a*" are provided along an interface of the back-folded parts of the joint 36*a* so as to join the edges of the side panel 31 more firmly together. Bosses 36*a*' and grooves 36*a*" serve as the reinforcing members, and both edges of the side panel 31 are folded to interlock the bosses and grooves. Seaming and caulking processes are then carried out on the edges.

According to the present invention, the joint of the spin basket's side panel is positioned in one of the lifters, and bosses and grooves are formed on the joint of the two edges of the side panel, thus reinforcing the connection. Accordingly, since the joint is positioned to more efficiently resist the applied centrifugal force, the two edges of the side panel are prevented from being disjoined, thus enhancing the reliability of the washing machine.

What is claimed is:

1. A spin basket for a drum type clothes washing machine, comprising a cylindrical side panel, the side panel including a rectangular sheet formed into a cylindrical shape, the sheet having opposed ends folded back around one another to form an interlocking joint, the sheet forming inwardly projecting lifters adapted to raise laundry during rotation of the spin basket, each lifter including an inwardly projecting wall, the interlocking joint disposed in one of the walls.

2. The spin basket according to claim 1 wherein the ends that are folded around one another engage one another along an interface, the ends including at least one intermeshing boss and groove at the interface.

3. The spin basket according to claim 2 wherein there is a plurality of bosses intermeshing with a plurality of grooves extending along the interface.

4. The spin basket according to claim 1 wherein each lifter comprises two walls converging inwardly, the interlocking joint disposed in one of the walls of one of the lifters.

* * * * *